US006182327B1

(12) United States Patent
Gosselin

(10) Patent No.: US 6,182,327 B1
(45) Date of Patent: Feb. 6, 2001

(54) CENTRAL VACUUM HOSE DISPENSER

(76) Inventor: Tilmon Joseph Paul Gosselin, 125 Principal Street, Memramcook, New Brunswick (CA), E4K 1A8

( * ) Notice: Under 35 U.S.C. 154(b), the term of this patent shall be extended for 0 days.

(21) Appl. No.: 09/482,347

(22) Filed: Jan. 14, 2000

(51) Int. Cl.[7] ..... A47L 9/00
(52) U.S. Cl. ..... 15/315; 137/355.16; 206/389
(58) Field of Search ..... 15/315; 137/355.16, 137/355.28; 242/386; 206/389

(56) References Cited

U.S. PATENT DOCUMENTS

| | | | | |
|---|---|---|---|---|
| 1,445,616 | | 2/1923 | Hotchkiss . | |
| 1,532,177 | * | 7/1925 | Gist | 137/355.28 X |
| 2,299,521 | * | 10/1942 | Zierden | 137/355.28 |
| 3,082,868 | * | 3/1963 | Hubbard | 206/389 X |
| 3,911,944 | | 10/1975 | Hukuba et al. . | |
| 4,739,535 | * | 4/1988 | Schuld et al. | 15/315 |
| 5,430,978 | | 7/1995 | Kohler . | |
| 5,526,842 | | 6/1996 | Christensen . | |
| 5,657,508 | * | 8/1997 | Herbreteau et al. | 15/315 |
| 5,740,581 | | 4/1998 | Harrelson, II . | |

FOREIGN PATENT DOCUMENTS 2093715 10/1994 (CA) .

* cited by examiner

*Primary Examiner*—Chris K. Moore
(74) *Attorney, Agent, or Firm*—Mario Theriault

(57) ABSTRACT

In a first aspect of the invention, there is provided an apparatus for storing and dispensing a vacuum hose of a central vacuum system. The apparatus comprises a base frame, a basket pivotally mounted on a thrust bearing affixed to the base frame, and a conduit rigidly held above the basket relative to the base frame and extending along the pivotal axis of the basket. When a vacuum hose is inserted downward inside the conduit and into the basket, the weight and resiliency of the hose causes the basket to rotate for coiling the hose therein without twisting it. The hose is thereby neatly stowable between uses. In another aspect, the base frame and the basket are installed beneath the floor of a house and the conduit extends upwardly into a wall cabinet above the main floor of the house and near a vacuum inlet socket of the central vacuum system.

20 Claims, 2 Drawing Sheets

CENTRAL VACUUM HOSE DISPENSER

FIELD OF THE INVENTION

The present invention relates to hose storage systems, and more particularly, the present invention relates to a gravity-operated central vacuum hose storage and dispenser installation.

BACKGROUND OF THE INVENTION

A central vacuum system uses a network of pipes connected to a powerful vacuum generator and filter located in a central location of a house for example. The piping system is connected to a number of vacuum inlets installed at various locations throughout the house. In use, a long vacuum hose is connected to one of these vacuum inlets for cleaning the rooms nearest to this inlet. Common vacuum hoses used with these central vacuum systems have 25 to 40 feet in length or more, and are difficult to stow away in a neat arrangement.

Various installations have been developed in the past for storing a vacuum hose. In its simplest and most common form of storage, the hose is coiled on a horseshoe-like wire-frame rack mounted out of sight in a closet or in a utility room. The more elaborate storage system known comprises a hose reel mounted inside the wall or in an equipment room of a house for example. Generally, the reel is electrically or spring driven, and the core of the reel has a swivel joint connected to a vacuum inlet pipe. Examples of the reel-type storage systems for central vacuum hoses are disclosed in the following Canadian Patent Application and US Patent: CA 2,093,715 published on Oct. 9, 1994 by G. Workhoven et al. U.S. Pat. No. 5,526,842 issued on Jun. 18, 1996 to L. G. Christensen.

Other vacuum hose storage systems of the prior art comprise a hose storage compartment wherein the hose is disorderly driven in or pulled out the compartment by a hose drive mechanism. The hose drive mechanism comprises a pair of spaced-apart indented rollers acting against the hose on opposite sides of the hose. Examples of these systems are illustrated in the following Patents:

U.S. Pat. No. 3,911,944 issued on Oct. 14, 1975 to H. Hukaba et al.

U.S. Pat. No. 5,740,581 issued on Apr. 21, 1998 to C. W. Harrelson II.

In a further example of the vacuum hose storage systems of the prior art, the hose is pushed in a pipe extending between the floorjoists or across the rafters of a building. This particular installation is described in the following Patent:

U.S. Pat. No. 5,430,978 issued on Jul. 11, 1995 to R. Kohler.

Although the vacuum hose storage systems of the prior art deserve undeniable merits, there is no known prior art installation that combines the advantages of having a compact arrangement, a simple drive system and the ability to stow a vacuum hose without potentially stretching, collapsing, twisting or kinking it. As such, it is believed that there continues to be a need for a hose storage and dispenser apparatus which is easily mountable in an existing building having a central vacuum system, which does not require an external source of power or the winding of a spring, and which does not apply any stress to the hose which may eventually deteriorate the hose.

SUMMARY OF THE INVENTION

The present invention provides for a vacuum hose storage and dispenser apparatus which operates by gravity, which does not require the use of pressure rollers against the hose, which does not twist the hose nor bend it beyond its natural bending radius and which is easy to install and to use.

Broadly, in a first aspect of the present invention, there is provided an apparatus for storing and dispensing a flexible and resilient hose. The apparatus comprises a base frame, a basket pivotally mounted to the base frame, and a conduit rigidly held above the basket relative to the base frame and extending along the pivotal axis of the basket.

A first advantage of the present invention is that when a flexible and resilient hose is adapted to be inserted downward inside the conduit and into the basket, the weight and resiliency of the hose causes the basket to rotate for coiling the hose therein without twisting it. The hose is thereby neatly stowable between uses.

In accordance with another feature of the present invention the conduit has an upper end and a lower end, a first flaring segment on the upper end and a second flaring segment on the lower end. The hose is thereby slid down or drawn out the conduit with ease.

In yet another feature of the present invention, the basket has a frustoconical shape whereby several coils of hose are stably supportable therein, laid more than one over another and against the inside wall surface of the basket.

Still a further feature of the present invention is that the basket is supported on a thrust bearing which is a Lazy Suzan-type bearing. This type of bearing is relatively easily and inexpensively available.

In accordance with another aspect of the present invention, there is provided an installation for storing and dispensing a vacuum hose of a central vacuum system. The installation according to this aspect of the present invention comprises a building structure consisting of a wall, a floor under that wall, floor joists under that floor and a wall cabinet mounted in that wall. The installation also comprises a frame affixed to the floor joists, a frustoconical basket pivotally mounted to the frame on a thrust bearing affixed to the frame. The basket has a vertical axis of rotation, an upper opened end, a rim circling the upper opened end, a closed bottom surface and an inside wall surface bordering the closed bottom surface. A conduit extends along the axis of rotation of the basket, from above the basket, through the floor, inside the wall and into the wall cabinet. A flexible and resilient vacuum hose extends inside the conduit and is partially coiled inside the basket.

The major advantages of this installation are that the vacuum hose is neatly stowed away in the conduit and under the floor and is easily accessible for use from the cabinet. Other advantages include the facts that the hose-storage basket takes very little space in a basement or a crawl space of a house, and that the installation can be mounted almost anywhere in a house. When the installation is mounted near a vacuum inlet socket, the vacuum hose is easily drawn from the conduit and the basket and readily connected to the socket for use. The wall cabinet further provides a convenient storage space for storing a number of accessories normally used with a vacuum hose.

Still another feature of the present invention is that it is susceptible of a low cost of manufacture with regard to materials, equipment and labour, and which accordingly is then susceptible of low price of sale to the industry, thereby making such vacuum hose storage and dispenser apparatus economically available to the public.

Other advantages and novel features of the invention will become apparent from the following detailed description.

BRIEF DESCRIPTION OF THE DRAWINGS

A preferred embodiment of the present invention selected by way of example will now be described with reference to the accompanying drawings in which.

DETAILED DESCRIPTION OF THE PREFERRED EMBODIMENT

Figure 1:
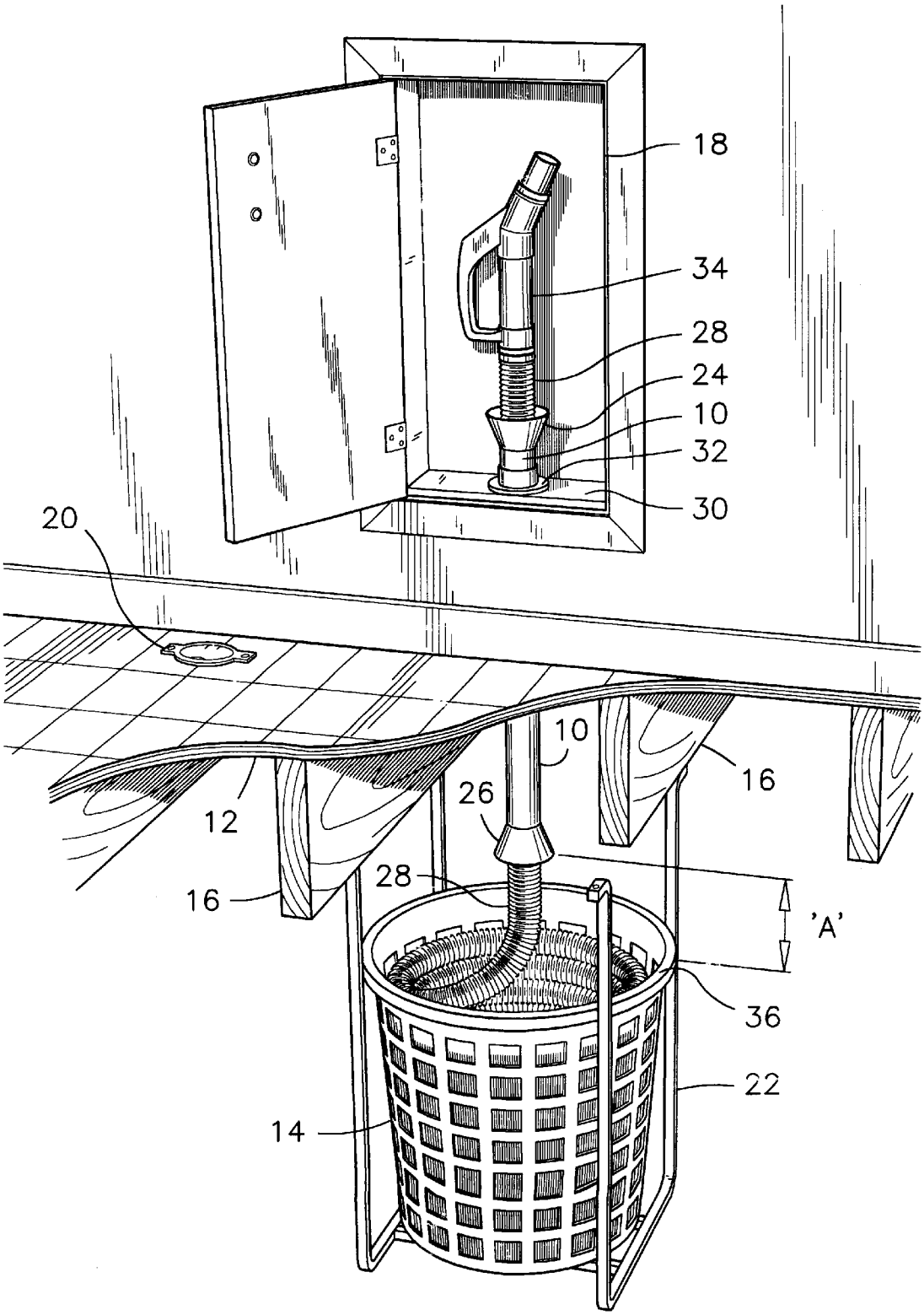
FIG. 1 illustrates a wall cabinet and a cross-section view through the floor of a building showing the hose-storage basket of the apparatus according to the preferred embodiment mounted to the floor joists below the wall cabinet.

While this invention is susceptible of embodiments in many various forms, there is shown in the drawings and will be described in details herein a specific embodiment, with the understanding that the present disclosure is to be considered as an example of the principles of the invention and is not intended to limit the invention to the embodiment illustrated.

The vacuum hose storage and dispenser apparatus according to the preferred embodiment of the present invention comprises broadly, a vertical pipe or conduit 10 extending through the main floor 12 of a building and above a hose-storage basket 14 suspended to floor joists 16 in a basement or a crawl space of that building. The upper end of the vertical conduit 10 is preferably mounted in a wall cabinet 18 at proximity of a vacuum inlet socket 20 of a central vacuum system (not shown). In the illustrated embodiment, the hose-storage basket 14 is mounted in a tubular frame 22 which is affixed to the floor joists 16 by screws (not shown) or otherwise. It will be appreciated that although a rectangular frame 22 is illustrated, a number of different frame arrangements can serve the same purpose as well.

The conduit 10 preferably has a first flaring segment 24 on its upper end and a second flaring segment 26 on its lower end to allow smooth and unobstructed movements of the vacuum hose 28 therethrough. The conduit 10 extends through the base 30 of the wall cabinet 18, and is held fixed to the base 30 of the wall cabinet 18 by means of a flange 32 affixed to conduit 10 and to the base 30 of the wall cabinet.

The vertical pipe or conduit 10 is made of PVC plastic or similar material. The inside diameter of the conduit 10 is slightly larger than the outside diameter of the vacuum hose 28 to be stored and dispensed, such that the vacuum hose can slide freely inside the conduit 10. In a stowed mode, a handle 34 for example, on the near end of the hose 28, prevents the near end of the hose 28 from sliding down through the conduit 10.

The conduit 10 is aligned toward the centre of the hose-storage basket 14, and extend to a distance 'A' of between about 6 and 7 inches (150–180 mm) above the rim 36 of the basket 14. This distance has been found to be convenient for storing a corrugated plastic vacuum hose having an outside diameter of about 1¾ to 2 inches (44–50 mm), in a basket having an inside diameter of between about 16 and 18 inches (40–46 cm). It will be appreciated that the distance 'A' can vary to accommodate the storage of vacuum hoses of other types and sizes, and the use of baskets of different dimensions.

For example, when a forty (40) foot hose is stored in a basket having an inside diameter of 18 inches (46 cm), the basket height should be sufficient to accommodate 8 to 10 coils of hose laid one over the other as partly illustrated in FIG. 1. With the hose size as mentioned above, the inside height of the basket should be approximately 18 to 20 inches (46–50 cm).

Figure 2:
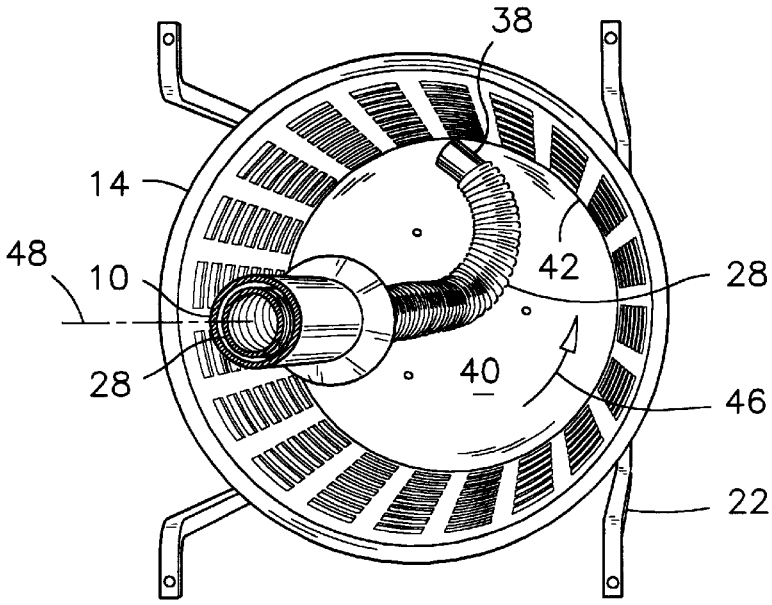
FIG. 2 illustrates a perspective top view of the hose-storage basket.
Figure 3:
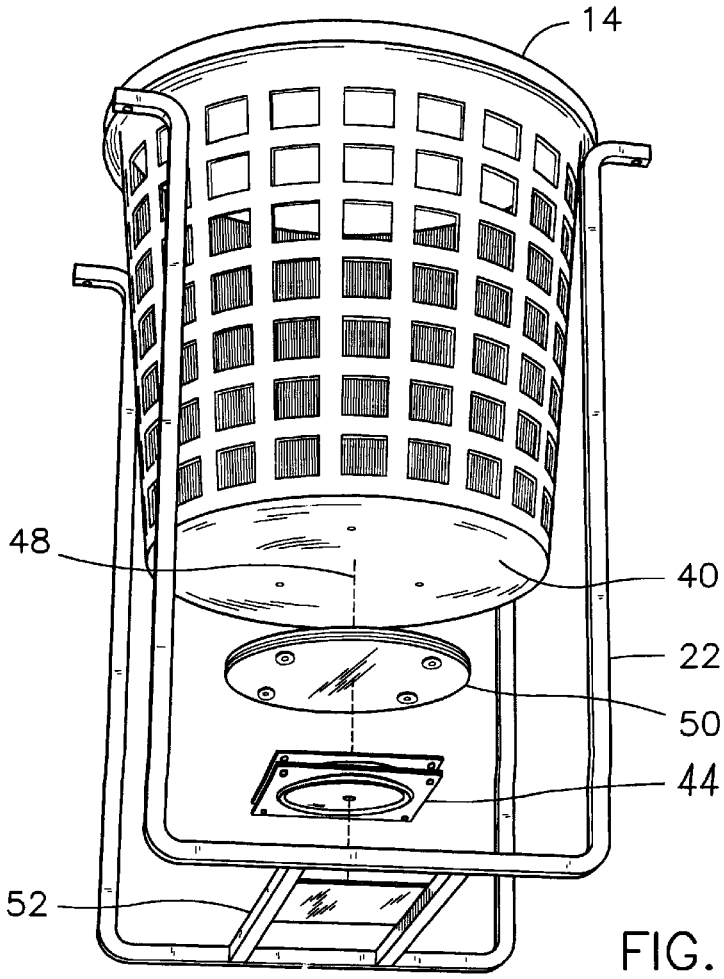
FIG. 3 illustrates a perspective exploded and side view of the hose-storage basket and of the basket support frame.

Referring now to FIGS. 2 and 3, the operation of the hose storage and dispenser apparatus according to the preferred embodiment will be explained in greater details.

When a corrugated plastic vacuum hose 28 is allowed to slide down through the conduit 10 under the influence of gravity, the far end 38 of the hose 28, or the hose tip, comes in contact with the bottom surface 40 of the basket 14, and slides toward the inside edge 42 of the basket 14, as illustrated in FIG. 2. The basket 14 is preferably made of a smooth plastic material such that its bottom surface 40 and its inside bottom edge 42 are smooth.

The basket 14 is mounted on a bearing 44 and is allowed to rotate freely relative to the tubular frame 22. Therefore, when the hose 28 is lowered into the basket 14, the tip 38 of the hose 28 pushes against the bottom 40 and inside edge 42 of the basket 14 and causes the basket 14 to rotate in the direction indicated by arrow 46 in the illustrated example. It will be appreciated that a flexible vacuum hose has a natural tendency to flex out of a straight line when suspended freely. Therefore, the placement of the conduit 10 along the axis of rotation 48 of the basket 14 facilitates the movement of the tip 38 of the hose towards the inside edge 42 of the basket. The movement of the tip 38 with the gravitational pull on the hose, or the weight of the hose, cause a rotational torque to be applied to the basket to rotate the basket.

During the rotation of the basket 14, the weight and resiliency of the hose 28 urge the hose to lay against the inside wall surface of the basket 14 without twisting. Once a first coil is formed, the inertia of the basket and of the hose cause the hose to climb over the tip 38 of the first coil to form a second and subsequent coils over the first one. The basket 14 preferably has a frustoconical shape to better support several coils of hose 28 laid more than one over another against the inside wall surface of the basket, as partly illustrated in FIG. 1.

The bearing 44 is preferably a thrust bearing of the Lazy Suzan-type, which is relatively easy to obtain and to install. The bearing 44 is preferably affixed to a plywood plate 50 which is mounted to the bottom surface 40 of the basket by means of wood screws for example (not shown) through the bottom surface 40 of the basket. The fixed part of the bearing 44 is affixed to bearing support base member 52 on the tubular frame 22.

When the hose is drawn from the storage and dispenser apparatus, it is simply pulled out by the handle 34. The pulling on the handle 34 causes the basket to rotate in a reverse direction thereby dispensing the hose out through the conduit 10 in a smooth and practically effortless manner.

Because the operation of the storage and dispenser apparatus requires that the hose 10 has a certain flexibility and resiliency, satisfactory operations have been obtained with common corrugated plastic vacuum hoses as well as with hoses covered with a light stretched hose sock. However, more or less satisfactory results may be obtained when using stiff hoses such as those having a thick fabric cover.

As to other maimer of manufacturing, usage and operation of the instant invention, the same should be apparent from the above description and accompanying drawings, and accordingly further discussion relative to these aspects would be considered repetitious and is not provided.

While one embodiment of the present invention has been described hereinabove, it will be appreciated by those skilled in the art that various modifications, alternate constructions and equivalents may be employed without departing from the true spirit and scope of the invention. For examples, those skilled in the art will appreciate that the frame 22 can have various configurations to satisfy different applications. The wall cabinet 18 may also have different configurations for storing a number of vacuum cleaner accessories or the like. The conduit may extend along a wall or inside a closet. One may contemplate the design of an alternate stand-alone or portable embodiment with a frame extending over the basket and supporting the lower end of the conduit. Similarly, the illustrated embodiment can be modified to stow and dispense flexible hoses different from those used in a central vacuum system. Therefore, the above description and the illustrations should not be construed as limiting the scope of the invention which is defined by the appended claims.

I claim:

1. An apparatus for storing and dispensing a flexible and resilient hose, comprising:

a base frame;

a basket pivotally mounted to said base frame, said basket having a vertical central axis, an upper opened end, a closed bottom surface and an inside wall surface bordering said closed bottom surface; and a conduit rigidly held relative to said base frame, above said basket and extending along said vertical central axis of said basket;

such that when a flexible and resilient hose is inserted downward inside said conduit and into said basket, a weight and resiliency of said hose causes said basket to rotate for coiling said hose in said basket without twisting said hose.

2. The apparatus as claimed in claim 1, wherein said vertical central axis is an axis of rotation of said basket.

3. The apparatus as claimed in claim 1, wherein said conduit has an upper end and a lower end, a first flaring segment on said upper end and a second flaring segment on said lower end.

4. The apparatus as claimed in claim 3, wherein said basket has a rim circling said upper opened end, and a distance between said lower end of said conduit and said rim is between about 6 and 7 inches.

5. The apparatus as claimed in claim 1, wherein said basket has a frustoconical shape.

6. The apparatus as claimed in claim 1, further comprising a bearing mounted between said base frame and said closed bottom surface of said basket.

7. The apparatus as claimed in claim 6, wherein said bearing is a Lazy Suzan-type thrust bearing.

8. The apparatus as claimed in claim 1, wherein said basket is made of a smooth plastic material.

9. The apparatus as claimed in claim 1, wherein said conduit is a PVC pipe.

10. An installation for storing and dispensing a flexible and resilient hose, comprising:

a building structure consisting of a wall, a floor under said wall, floor joists under said floor, and a cabinet mounted in said wall, said cabinet having a base member;

a frame mounted to said floor joists;

a basket pivotally mounted to said frame, said basket having a vertical axis of rotation, an upper opened end, a rim circling said upper opened end, a closed bottom surface and an inside wall surface bordering said closed bottom surface, and a conduit extending along said vertical axis of rotation of said basket, from above said basket, through said floor, inside said wall and through said base of said cabinet;

such that when a flexible and resilient hose is inserted downward inside said conduit and into said basket, a weight and resiliency of said hose causes said basket to rotate for coiling said hose in said basket without twisting said hose, whereby said hose is neatly stowable in said conduit and under said floor and is accessible for use from said cabinet.

11. The installation as claimed in claim 10, wherein said conduit comprises a flange which is affixed to said base of said cabinet.

12. The installation as claimed in claim 11, wherein said conduit has an upper end in said cabinet and a lower end above said basket, a first flaring segment on said upper end and a second flaring segment on said lower end.

13. An installation for storing and dispensing a vacuum hose of a central vacuum system, comprising:

a building structure consisting of a wall, a floor under said wall, floor joists under said floor and a cabinet mounted in said wall, said cabinet having a base member;

a frame mounted to said floor joists;

a basket pivotally mounted to said frame, said basket having a vertical axis of rotation, an upper opened end, a rim circling said upper opened end, a closed bottom surface and an inside wall surface bordering said closed bottom surface;

a conduit extending along said vertical axis of rotation of said basket, from above said basket, through said floor, inside said wall and through said base of said cabinet, and a flexible and resilient vacuum hose extending inside said conduit and being partially coiled inside said basket;

such that said vacuum hose is neatly stowed away in said conduit and under said floor and is accessible for use from said cabinet.

14. The installation as claimed in claim 13, wherein said conduit has an upper end in said cabinet and a lower end above said basket, a first flaring segment on said upper end and a second flaring segment on said lower end.

15. The installation as claimed in claim 14, wherein said vacuum hose is a corrugated plastic hose.

16. The installation as claimed in claim 15, wherein said basket has an inside diameter of about 18 inches and a height corresponding to about 10 coils of said vacuum hose laid more than one over another inside said basket.

17. The installation as claimed in claim 16, wherein said vacuum hose has an outside diameter of between 1¾ and 2 inches, and a distance between said lower end of said conduit and said rim of said basket is between about 6 and 7 inches.

18. The installation as claimed in claim 17, wherein said basket is made of smooth plastic material and has a frustoconical shape.

19. The installation as claimed in claim 18, further comprising a thrust bearing mounted between said frame and said basket.

20. The installation as claimed in claim 13, further comprising a vacuum inlet socket in said floor at a vicinity of said cabinet.

* * * * *